US009366435B2

(12) United States Patent
Soda et al.

(10) Patent No.: US 9,366,435 B2
(45) Date of Patent: Jun. 14, 2016

(54) IGNITION TORCH AND PRESSURIZED GASIFICATION FURNACE INCLUDING THE SAME

(75) Inventors: Yasuo Soda, Tokyo (JP); Takashi Yamamoto, Tokyo (JP); Katsuhiko Yokohama, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 426 days.

(21) Appl. No.: 13/814,849

(22) PCT Filed: Nov. 29, 2010

(86) PCT No.: PCT/JP2010/071211
§ 371 (c)(1),
(2), (4) Date: Feb. 7, 2013

(87) PCT Pub. No.: WO2012/073299
PCT Pub. Date: Jun. 7, 2012

(65) Prior Publication Data
US 2013/0143171 A1 Jun. 6, 2013

(51) Int. Cl.
*F23Q 13/04* (2006.01)
*F23D 14/38* (2006.01)

(52) U.S. Cl.
CPC ..... *F23Q 13/04* (2013.01); *F23D 14/38* (2013.01)

(58) Field of Classification Search
CPC ..... F23D 14/38; F23Q 13/04
USPC ..... 431/353, 127, 130
See application file for complete search history.

(56) References Cited

U.S. PATENT DOCUMENTS 3,694,134 A * 9/1972 Ross ..... F23Q 3/002 361/260
4,427,362 A * 1/1984 Dykema ..... F23C 6/045 110/345
2005/0112518 A1* 5/2005 Watanabe ..... 431/153

FOREIGN PATENT DOCUMENTS

JP 59-9014 2/1984
JP 2008-231326 10/2008
JP 2008231326 A * 10/2008
JP 2008-304138 12/2008
JP 2008304138 A * 12/2008

OTHER PUBLICATIONS

Machine translations for both Japanese documents.*
International Search Report issued Dec. 28, 2010 in International (PCT) Application No. PCT/JP2010/071211.
Decision to Grant a Patent issued Aug. 6, 2015 in corresponding Chinese patent application No. 201080068489.6.

* cited by examiner

*Primary Examiner* — Gregory Huson
*Assistant Examiner* — Aaron Heyamoto
(74) *Attorney, Agent, or Firm* — Wenderoth, Lind & Ponack, L.L.P.

(57) ABSTRACT

An ignition torch that can easily be inspected regardless of the state inside a gasification furnace. The ignition torch (10) extends from an outside of a gasification furnace (1) to an inside of the gasification furnace (1) so as to receive feed of fuel and combustion air from one end positioned outside of the gasification furnace (1) and to feed flames to the other end positioned in the inside of the gasification furnace (1). An opening/closing valve (24) is provided downstream in a fuel flow direction from an ignition section (22) provided at the outside of the gasification furnace (1). A flame-holding section (28) is provided on the other end of the ignition torch (10). Supporting fuel is supplied to the flame-holding section (28).

2 Claims, 2 Drawing Sheets

IGNITION TORCH AND PRESSURIZED GASIFICATION FURNACE INCLUDING THE SAME

BACKGROUND OF THE INVENTION

1. Technical Field

The present invention relates to an ignition torch, and more preferably relates to an ignition torch adequate for use in a pressurized gasification furnace.

2. Description of the Related Art

In the vicinity of a start burner for a gasification furnace, such as a coal gasification furnace, an ignition torch is provided to ignite the start burner.

Japanese Examined Patent Application, Publication No. Sho 59-9014 discloses a pilot burner which is not for use in coal gasification furnaces but for use in incinerators and boilers. This pilot burner is configured to have an ignition section provided on a base end side and a flame-holding section provided on a distal-end side inside the furnace.

SUMMARY OF THE INVENTION

1. Technical Problem

The ignition torch for use in coal gasification furnaces needs to be inspected when various failures occur. However, when the pilot burner described in JP Publication No. 59-9014 is used as an ignition torch for the coal gasification furnace, the ignition section side cannot be inspected during operation of the gasification furnace since the inside of the gasification furnace is connected to an ignition section. Accordingly, when inspection of the ignition torch is needed, the pressure in all the facilities of the gasification furnace under pressurized operation is required to be reduced to normal pressure, and this procedure takes time. Moreover, it takes considerable cost and energy to operate various engines at the time of recompression after the inspection.

The present invention has been made in view of such circumstances and it is an object of the present invention to provide an ignition torch that can easily be inspected regardless of the state inside the gasification furnace.

2. Solution to the Problem

An ignition torch of the present invention employs the following solutions to solve the foregoing problems.

An ignition torch of the present invention is an ignition torch extending from the outside of a gasification furnace to the inside of the gasification furnace so as to receive feed of fuel and combustion air from one end positioned at the outside of the gasification furnace and to feed flames to the other end positioned in the inside of the gasification furnace. The ignition torch includes an opening/closing valve provided downstream in a fuel flow direction from ignition means provided in the outside of the gasification furnace.

The ignition torch includes the opening/closing valve provided downstream in the fuel flow direction from the ignition means provided in the outside of the gasification furnace, so that the inside of the gasification furnace and the ignition means side can be separated by closing the opening/closing valve. Therefore, in the case where inspection of the ignition torch is required due to various failures, the ignition means side can be separated from the inside of the gasification furnace by closing the opening/closing valve. As a result, inspection can easily be implemented regardless of the state of the gasification furnace.

The ignition torch of the present invention further includes a flame-holding section provided on the other end, wherein auxiliary fuel is supplied to the flame-holding section.

In this ignition torch, flames inside the flame-holding section positioned on the other end have a slowed traveling speed, so that the flames temporarily remain and generate main flames. Since auxiliary fuel is directly charged into the flame-holding section, an atmosphere of high concentration fuel is obtained, and thereby the main flames can be held more stably.

Further in the present invention, a pressurized gasification furnace includes the ignition torch.

According to the ignition torch, the inside of the gasification furnace and the ignition means side can be separated by closing the opening/closing valve. Therefore, when the inside of a gasification furnace is pressurized as in pressurized gasification furnaces, inspection can easily be implemented without the necessity of reducing the pressure inside the gasification furnace to normal pressure.

3. Advantageous Effects of the Invention

Since the ignition torch of the present invention has the above-stated configuration, it has efficient effects as shown below.

The inside of the gasification furnace and the ignition means side can be separated by closing the opening/closing valve of the ignition torch. Therefore, inspection can easily be implemented regardless of the state of the gasification furnace.

Since auxiliary fuel is directly charged into the flame-holding section of the ignition torch, an atmosphere of high concentration fuel is obtained, and thereby main flames can be held more stably.

The inside of the pressurized gasification furnace and the ignition means side can be separated by closing the opening/closing valve of the ignition torch. Therefore, even when the inside of the gasification furnace is pressurized as in pressurized gasification furnaces, inspection can easily be implemented without the necessity of reducing the pressure inside the gasification furnace to normal pressure.

DETAILED DESCRIPTION OF THE INVENTION

Figure 1:
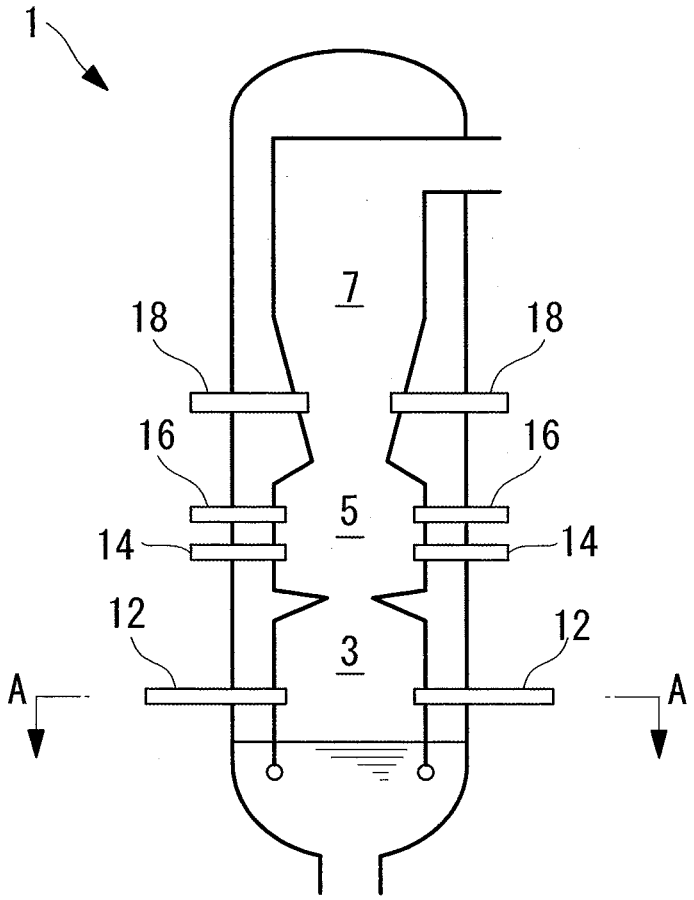
FIG. 1 is a longitudinal sectional view showing a coal gasification furnace container of the present invention.

Hereinafter, one embodiment regarding an ignition torch of the present invention will be described with reference to FIGS. 1 to 3. FIG. 1 is a longitudinal sectional view showing a coal gasification furnace container of the present invention. A gasification furnace 1 includes a light combustion chamber 3, a combustor section 5, and a reductor section 7 in order from the bottom side.

The light combustion chamber 3 includes a start burner 12. Although not shown in FIG. 1, an ignition torch 10 is provided in the vicinity of the start burner 12 as shown in FIG. 2.

The combustor section 5 includes a pulverized coal burner 14 and a char burner 16. The reductor section 7 includes a gasification burner 18.

In the light combustion chamber 3, spray-injected light oil is combusted by the start burner 12, and combustion gas generated thereby heats the combustor section 5 on the upper side. In the combustor section 5 which was heated to coal ignition temperature or more, air serving as a gasifying agent, which is injected only into the combustor section 5, and coal are combusted to provide high temperature, at which ashes in coal melt and flow down. High-temperature gas generated by combustion in the combustor section 5 ascends to the reductor section 7, where the gas reacts with newly charged coal, so that the coal is efficiently converted to gas.

Figure 2:
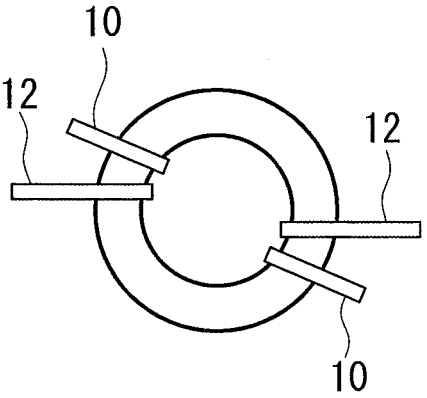
FIG. 2 is a cross sectional view taken along line A-A of FIG. 1 of the present invention.

As shown in FIG. 2, the ignition torch 10 is placed in the vicinity of each start burner 12, and the start burner 12 is ignited with flames of the ignition torch 10. Moreover, in the present embodiment, two start burners 12 are provided. These start burners 12 are placed facing each other so that a swirling flow is generated in the furnace.

Figure 3:
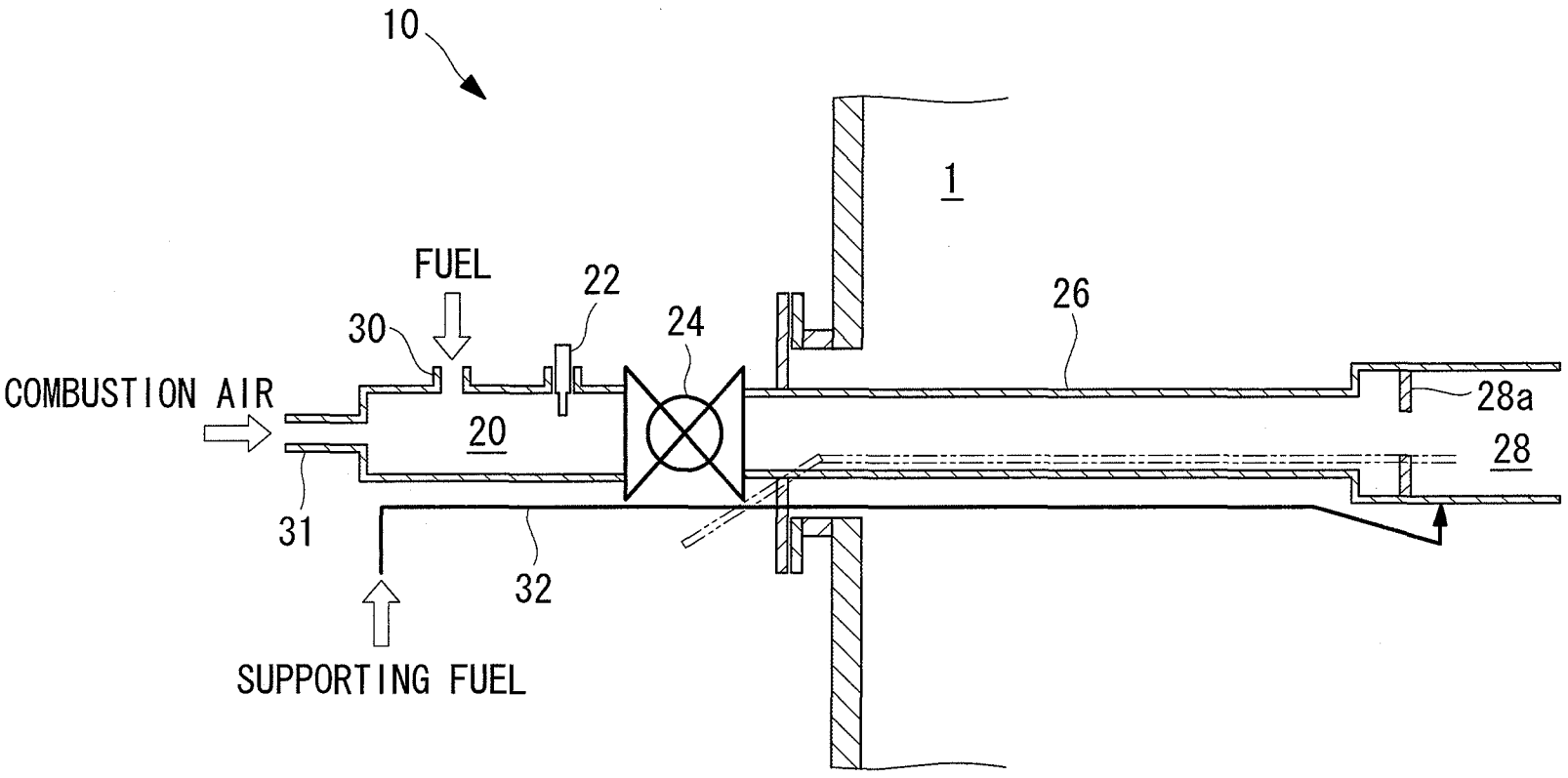
FIG. 3 is a longitudinal sectional view showing an ignition torch of the present invention.

The details of the ignition torch 10 are shown in FIG. 3. The ignition torch 10 includes a mixing chamber 20 for mixing fuel and air, an ignition section 22, an opening/closing valve 24, a combustion pipe 26, and a flame-holding section 28, which are provided as principle sections in order from the base end in the outside of the gasification furnace 1.

The mixing chamber 20 includes a fuel supply port 30 and a combustion air supply port 31. Fuel and combustion air are sufficiently mixed in the mixing chamber 20 and are ignited in the ignition section 22 provided downstream in the fuel flow direction. As the ignition section 22, a glow plug is preferably used for ignition.

The mixing chamber 20 and the ignition section 22 are placed outside of the gasification furnace 1. The opening/closing valve 24 is provided between the mixing chamber 20 and the combustion pipe 26 extending into the inside of the pressurized gasification furnace 1. The opening/closing valve 24 is provided in the outside of the gasification furnace 1. With the opening/closing valve 24, the flow of fluid between the ignition section side and the gasification furnace side can be cut off. At the distal end (other end) of the combustion pipe 26, the flame-holding section 28 is provided with a flame holder 28*a* that is fixed to the inside of a tube whose inner dimension is larger than the combustion pipe 26.

A supporting fuel pipe 32 for circulating supporting fuel (auxiliary fuel) is inserted into the furnace from the outside of the furnace. The supporting fuel pipe 32 extends beside the combustion pipe 26 up to the flame-holding section 28. The supporting fuel is supplied to the flame-holding section 28 through the supporting fuel pipe 32.

The ignition torch 10 according to the above-stated present embodiment operates as shown below.

First, prior to ignition, only combustion air is supplied from the combustion air supply port 31 to red-heat the ignition section 22.

After the ignition section 22 is heated to ignition temperature, fuel is further supplied from the fuel supply port 30 into the mixing chamber 20, where the fuel and the combustion air are mixed. An air ratio (actually charged air amount/theoretically required air amount) at this point is set to about 0.4 to 0.7.

Mixed gas ignites in the ignition section 22 and forms flames. The flames pass the opening/closing valve 24 in an opened state and transmit through the combustion pipe 26.

The flames that have reached the flame-holding section 28 through the combustion pipe 26 turn into main flames inside the flame-holding section 28 and combust. At this point, supporting fuel is supplied through the supporting fuel pipe 32 to the flame-holding section 28. As a consequence, the main fire grown in the flame-holding section 28 stably combusts.

After the main flames in the flame-holding section 28 are stabilized, flames flowing out of the flame-holding section 28 ignite the start burner 12.

A description is now given of how to use the opening/closing valve 24.

The inside of the gasification furnace 1 is maintained not only under a high temperature condition but also at a high pressure state on the constant basis mainly for promoting combustion and gasification reactions of char. Therefore, in the case of inspecting the ignition torch 10, it takes time to reduce the pressure in all the facilities of the gasification furnace under pressurized operation to normal pressure, so that considerable cost and energy are to be incurred to operate various engines at the time of recompression after the inspection.

When such an inspection of the ignition torch 10 is required, the opening/closing valve 24, which is provided downstream in the fuel flow direction from the ignition section 22 provided outside the gasification furnace 1, is used. More specifically, in the case where trouble occurs in the ignition torch at the time of ignition of the torch or during operation of the start burner and therefore inspection of the ignition torch is required, the opening/closing valve 24 is closed in that state. As a consequence, the inside of the gasification furnace 1 is cut off from the ignition section side, so that the ignition section side can be opened to the air and inspection work can be performed.

Hereinafter, functions and effects of the present embodiment will be described. The inside of the gasification furnace 1 is maintained not only under a high temperature condition but also at a high pressure state on a constant basis mainly for promoting combustion and gasification reactions of char. Therefore, in the case of inspecting facilities and devices, it takes time to reduce the pressure in all the facilities of the gasification furnace under pressurized operation to normal pressure, so that considerable cost and energy are to be incurred to operate various engines at the time of recompression after the inspection. However, the ignition torch 10 includes the opening/closing valve 24 capable of separating the inside of the pressurized gasification furnace from the ignition means side. Therefore, inspection can easily be implemented without the necessity of reducing the pressure inside the pressurized gasification furnace to normal pressure.

Moreover, since auxiliary fuel is supplied through the fuel pipe 32 connected to the flame-holding section 28, the main fire combusts more stably, which can ensure ignition of the ignition torch 10. Therefore, the frequency of reducing the pressure inside the pressurized gasification furnace to normal pressure to implement inspection is decreased.

REFERENCE SIGNS LIST

1 Gasification furnace
10 Ignition torch
12 Start burner
20 Mixing chamber
22 Ignition section
24 Opening/closing valve
26 Combustion pipe
28 Flame-holding section
32 Fuel pipe

The invention claimed is:

1. A pressurized gasification furnace including an ignition torch extending from an outside of a gasification furnace to an inside of the gasification furnace which is pressurized during operation, the ignition torch comprising:

a first end positioned outside of the gasification furnace;

a second end positioned inside of the gasification furnace;

an ignition device positioned outside of the gasification furnace; and an opening/closing valve located outside of the gasification furnace and disposed downstream in a fuel flow direction relative to the ignition device, wherein the entire ignition device is disposed upstream of the opening/closing valve in the fuel flow direction, wherein a fuel supply port and a combustion air supply port are provided at the first end of the ignition torch for receiving fuel and combustion air and feeding the fuel and the combustion air to the second end of the ignition torch positioned in the inside of the gasification furnace in order to make flames at the second end.

2. The pressurized gasification furnace according to claim 1, wherein a flame-holding section is provided at the second end of the ignition torch, and an auxiliary fuel pipe is provided to supply auxiliary fuel to the flame-holding section.

* * * * *